US008746205B2

(12) United States Patent
Torkildsen

(10) Patent No.: US 8,746,205 B2
(45) Date of Patent: Jun. 10, 2014

(54) DEVICE FOR TRANSMISSION OF FORCE FROM THE PISTONS OF A PISTON ENGINE

(76) Inventor: Odd Bernhard Torkildsen, Oslo (NO)

( * ) Notice: Subject to any disclaimer, the term of this patent is extended or adjusted under 35 U.S.C. 154(b) by 93 days.

(21) Appl. No.: 13/514,368

(22) PCT Filed: Nov. 18, 2010

(86) PCT No.: PCT/NO2010/000420
§ 371 (c)(1),
(2), (4) Date: Jun. 7, 2012

(87) PCT Pub. No.: WO2012/067514
PCT Pub. Date: May 24, 2012

(65) Prior Publication Data
US 2012/0240894 A1 Sep. 27, 2012

(51) Int. Cl.
*F02B 75/32* (2006.01)
*F02B 75/24* (2006.01)
*F02B 75/18* (2006.01)

(52) U.S. Cl.
USPC ..... 123/197.4; 123/197.1; 123/53.3; 123/56.1

(58) Field of Classification Search
USPC ..... 123/197.1, 52.1, 53.3, 56.1, 46 R, 46 E
See application file for complete search history.

(56) References Cited

U.S. PATENT DOCUMENTS

| | | | | |
|---|---|---|---|---|
| 1,893,045 | A * | 1/1933 | Weidner | 123/53.3 |
| 4,516,539 | A * | 5/1985 | Andreen | 123/51 B |
| 4,708,099 | A * | 11/1987 | Ekker | 123/53.4 |
| 5,167,292 | A * | 12/1992 | Moiroux et al. | 180/165 |
| 5,704,274 | A * | 1/1998 | Forster | 92/165 R |
| 7,140,343 | B2 * | 11/2006 | Sanderson | 123/197.1 |
| 2009/0179424 | A1 * | 7/2009 | Yaron | 290/52 |
| 2012/0240894 | A1 * | 9/2012 | Torkildsen | 123/197.1 |
| 2013/0186354 | A1 * | 7/2013 | Torkildsen | 123/41.72 |

FOREIGN PATENT DOCUMENTS

| | | | |
|---|---|---|---|
| NO | 329846 | B1 | 1/2011 |
| WO | 2009113862 | A1 | 9/2009 |

* cited by examiner

*Primary Examiner* — Lindsay Low
*Assistant Examiner* — Tea Holbrook
(74) *Attorney, Agent, or Firm* — David A. Guerra

(57) ABSTRACT

Device for transmission of force from the pistons of a piston engine, where the pistons of two opposite combustion cylinders cooperate with alternating power strokes, the common piston rods of the cylinders being supported on a balance arm at a distance from the bearing of the balance arm to perform a rocking movement around the bearing, where the piston rods of two further opposite and cooperating combustion cylinders being supported on the balance arm opposite and at a distance from the bearing, and the balance arm being connected with a flywheel, where the bearings on the balance arm between the bearings of the balance arm and the bearings of the piston rods on the balance arm being directly connected with a shaft for energy transforming means.

4 Claims, 2 Drawing Sheets

DEVICE FOR TRANSMISSION OF FORCE FROM THE PISTONS OF A PISTON ENGINE

CROSS-REFERENCE TO RELATED APPLICATIONS

This application is an U.S. national phase application under 35 U.S.C. §371 based upon co-pending International Application No. PCT/NO2010/000420 filed on Nov. 18, 2010. Additionally, this U.S. national phase application claims the benefit of priority of co-pending International Application No. PCT/NO2010/000420 filed on Nov. 18, 2010. The entire disclosure of the prior application is incorporated herein by reference. The international application was published on May 24, 2012 under Publication No. WO 2012/067514 A1.

BACKGROUND OF THE INVENTION

1. Field of the Invention

The present invention is related to a device for transmission of force from the pistons of a piston engine, according to the preamble of the claims.

2. Description of the Prior Art

Transmission of force from the pistons of a piston combustion engine normally is made by the piston rods of the cylinders to a crankshaft. The transmission to the crankshaft is dependent on the angle of the crank arm in relation to the movement of the piston, thereby transforming the linear movement to the rotation of the crankshaft.

SUMMARY OF THE INVENTION

With the device for transmission of the force from the pistons of a piston engine according to the present invention the piston force is transformed substantially from the moment of ignition. This is obtained with the device according to the present invention as defined by the features stated in the claims.

Devices within this technical field are known i.a. from U.S. Pat. Nos. 4,516,539 and 2,384,401.

With the device according to the invention the force from the pistons may be utilized mechanically, electrically, pneumatically or hydraulically.

BRIEF DESCRIPTION OF THE DRAWINGS

The invention will be better understood and objects other that those set forth above will become apparent when consideration is given to the following detailed description thereof. Such description makes reference to the annexed drawings wherein.

DETAILED DESCRIPTION OF THE INVENTION

Figure 1:
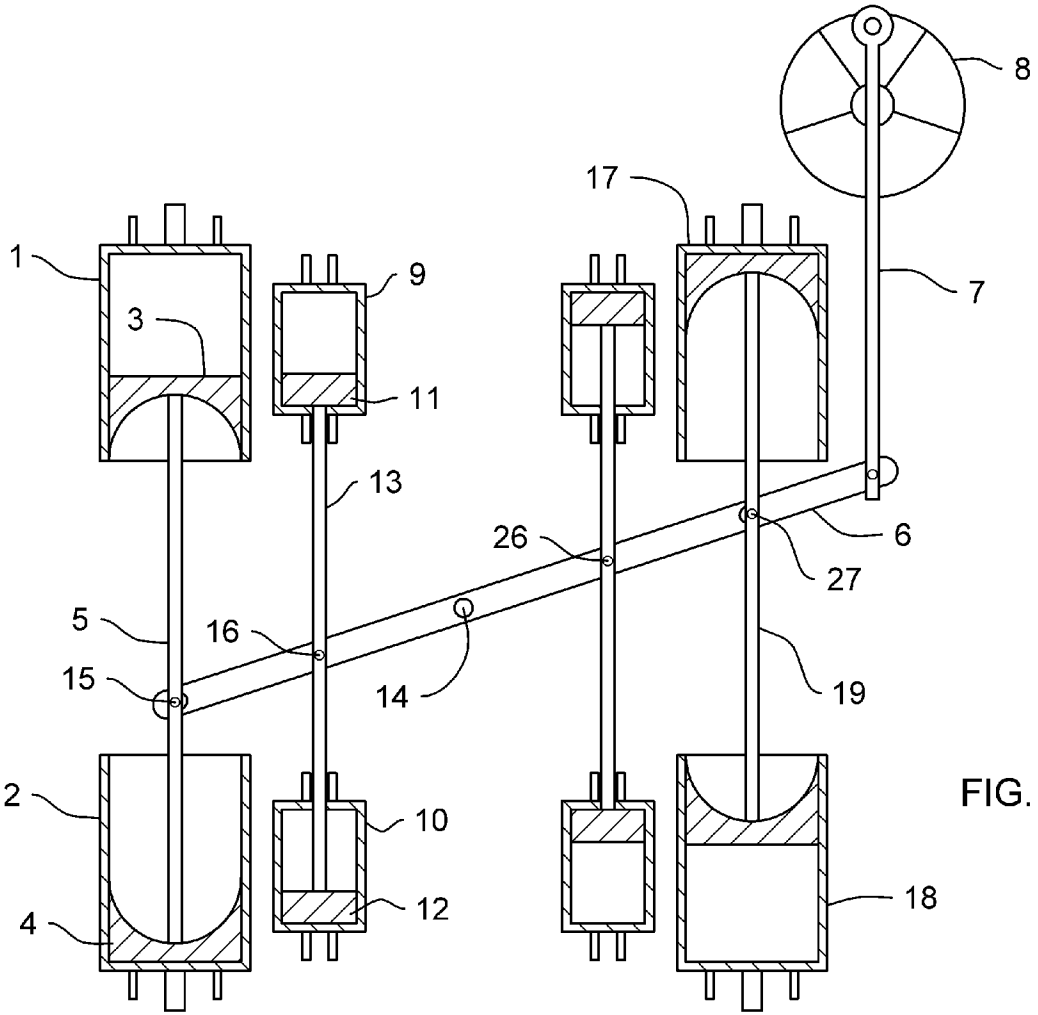
FIG. 1 of the drawing discloses a principal sketch of one embodiment of the device for transforming the kinetic energy of the pistons to hydraulic energy, and FIG. 2 discloses a principal sketch of a device transforming the energy to electric energy.

According to the invention two opposite cylinders 3 and 4 are connected by a common piston rod 5 being connected to a balance arm 6 in a bearing 15. The common piston rod 5 possibly may be split having bearings in the pistons and in the balance arm as well. Said balance arm 6 is connected with an arm 7 operating a flywheel 8 securing continuous operation of the pistons. Each combustion cylinder 1, 2 comprises as well known valves for supply of fuel and air and for exhaust gas as well as an ignition mechanism.

The balance arm 6 is supported on a shaft 14 at a distance from the bearing 15 of the piston rod 5, thereby carrying out a rocking movement in one direction by ignition of the fuel in one cylinder 1 and a return movement by ignition of the fuel in the opposite cylinder 2. The cylinders 1, 2 may operate according to the two-cycle or the four-cycle principle. Further opposite cylinders 17, 18 having a common piston rod 19 being supported in a bearing 27 on the balance arm 6 at a distance corresponding from the shaft 14 of the balance arm on the opposite side of the shaft 14.

The piston rods 5, 19 may be through going and supported in slide bearings in the bearings 15, 27 on the balance arm 6 to assume the movements of same or the piston rods 5, 19 may be split and supported in bearings 15, 27 on the balance arm 6 and in the pistons.

The balance arm 6 is connected with energy transforming means for transfer of mechanical, hydraulic, electric or pneumatic energy to be utilized.

For mechanical utilization of the energy the rotation energy of the flywheel 8 may be used or a separate flywheel may be connected with the balance arm 6 in another way to transform the rocking movement to rotary energy.

For transfer of the energy to hydraulic energy two opposite hydraulic cylinders 9 and 10 may have pistons 11 and 12 with a common piston rod 13 supported in a bearing 16 on the balance arm 6 between the bearing 15 for the piston rod 5 of the combustion cylinders and the shaft 14, as disclosed in FIG. 1. The piston rod 13 may be in one piece or being split having a piston rod from the balance arm 6 to each cylinder 9 and 10. The hydraulic cylinders 9, 10 comprise valves for pressurized hydraulic oil and for non pressurized hydraulic oil. Correspondingly the hydraulic cylinders comprise a common piston rod being supported in a bearing 26 on the balance arm at a distance from the bearing 15 of the bearing arm corresponding with the bearing 16 of the first piston rod 13 on the other side of the bearing 15 of the balance arm.

Figure 2:
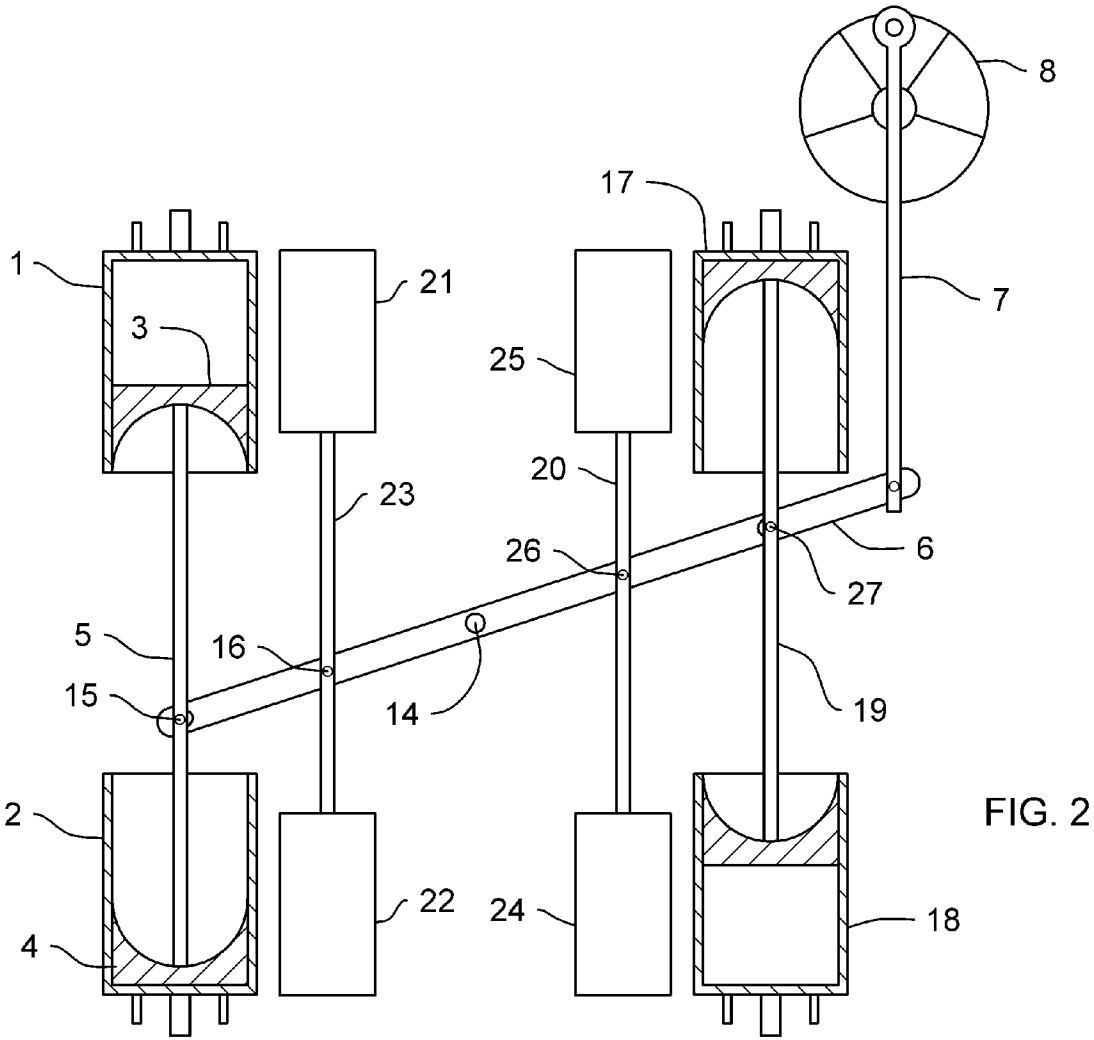

For transferring the energy to electric energy an arm 20, 23 on each side of the shaft 14 of the balance arm may be connected with the balance arm 6 for operation of generators 21, 22, 24 and 25, as disclosed in FIG. 2.

The invention claimed is:

1. A device for transmission of force from pistons of a piston engine, said device comprising:

a balance arm being supported on a shaft at a distance configured to perform a rocking movement around said shaft;

a first set of opposed combustion cylinders each having a piston configured to cooperate with alternating power strokes, said piston of each of said combustion cylinders being interconnected by a first combustion piston rod, said first combustion piston rod being supported by a first slide bearing associated with a first hole defined in said balance arm at a distance from said shaft of said balance arm;

a second set of opposed combustion cylinders each having a piston configured to cooperate with alternating power strokes, said piston of each of said combustion cylinders being interconnected by a second combustion piston rod, said second combustion piston rod being supported by a second slide bearing associated with a second hole defined in said balance arm at a distance from said shaft of said balance arm opposite said first slide bearing;

a first set of opposed energy transforming means connected to said balance arm by a first bearing between said first sliding bearing and said shaft;

a second set of opposed energy transforming means connected to said balance arm by a second bearing between said second sliding bearing and said shaft; and a flywheel connected to said balance arm;

wherein said first and second holes each being configured to allow movement of said first and second combustion piston rods respectively while ends of said balance arm travel in a substantial arc.

2. The device according to claim 1, wherein said first and second set of energy transforming means each being a piston rod having ends, each end of said piston rod is configured to provide hydraulic pressure in a cylinder with a piston connected to said end respectively.

3. The device according to claim 1, wherein said first and second set of energy transforming means each being an arm connected with said balance arm on of each side of said shaft, said arm having ends configured to operate a generator.

4. The device according to claim 1, wherein said first and second piston rods are rigidly connected to said pistons of said first and second set of opposed combustion cylinders respectively.

* * * * *